US006135608A

United States Patent [19]

Lin

[11] Patent Number: 6,135,608

[45] Date of Patent: Oct. 24, 2000

[54] HAND TOOL AND LAMP ARRANGEMENT

[76] Inventor: Fang-Lan Lin, No. 70, Lane 671, Chunghsing Rd., Sec. 2, Tali City, Taichung County, Taiwan

[21] Appl. No.: 09/383,443

[22] Filed: Aug. 27, 1999

[51] Int. Cl.[7] ..... B25B 23/18

[52] U.S. Cl. ..... 362/119; 362/109

[58] Field of Search ..... 362/109, 119, 362/120, 253, 206

[56] References Cited

U.S. PATENT DOCUMENTS

| | | | |
|---|---|---|---|
| 5,628,556 | 5/1997 | Hrabar et al. | 362/119 |
| 5,690,414 | 11/1997 | Jeng | 362/120 |
| 5,713,656 | 2/1998 | Lin | 362/120 |

*Primary Examiner*—Stephen Husar
*Attorney, Agent, or Firm*—Rosenberg, Klein & Lee

[57] ABSTRACT

A hand tool and lamp assembly arrangement, which includes a tool handle having a front end for holding any of a variety of tool elements, and a lamp assembly mounted in the tool handle to emit light through the front end of the tool handle, wherein the tool handle is made of transparent material, having an outer thread at a rear end thereof, a receiving chamber extended through the front end and rear end thereof, a hollow screw cap threaded onto the outer thread to hold down the lamp assembly, and a rubber covering covered on one end of the lamp assembly and held in place by the hollow screw cap to seal the rear end of the hand tool; the lamp assembly is a hand torch light having an on/off button covered by the rubber covering and extended out of the hollow screw cap for operation by hand.

4 Claims, 2 Drawing Sheets

HAND TOOL AND LAMP ARRANGEMENT

BACKGROUND OF THE INVENTION

The present invention relates to a hand tool and lamp arrangement, and more particularly to such a hand tool and lamp arrangement in which the lamp assembly can be taken away from the tool handle for use as a hand torch light independently.

A variety of hand tool and lamp combination devices have been disclosed, and have appeared on the market. These hand tool and lamp combination devices commonly comprise a hollow tool handle, and a lamp circuit assembly installed in the tool handle. The lamp circuit assembly comprises a bulb, a battery, switch means, metal contact plates, and conductors. By means of operating the switch means, the bulb is turned on/off. These conventional hand tool and lamp combination devices are functional, however they are still not satisfactory in function. The drawbacks of these conventional hand tool and lamp combination devices are outlined hereinafter.

1. Complicated structure and manufacturing process:

The separated design of the tool handle and the complicated structure of the lamp circuit assembly greatly complicate the fabrication of the related moldings, and increase the manufacturing cost of the combination device. Because a number of parts are used, the assembly process as well as the inventory control are complicated.

2. Low structural strength:

Because the tool handle is a separated design, the connecting area between parts is less strong, and the tool handle tends to be broken by an impact.

3. Limited application purpose:

Because the bulb, battery, metal contact plates and conductors of the lamp circuit assembly are directly fastened to the inside of the tool handle, the lamp circuit assembly cannot be separated from the tool handle for use independently.

SUMMARY OF THE INVENTION

The present invention has been accomplished to provide a hand tool and lamp arrangement, which eliminates the aforesaid drawbacks. According to one aspect of the present invention, the hand tool and lamp assembly arrangement comprises a tool handle having a front end for holding any of a variety of tool elements, a set of tool elements for coupling to the front end of the tool handle, and a lamp assembly mounted in the tool handle to emit light through the front end of the tool handle, wherein the tool handle is made of transparent material, comprising an outer thread at a rear end thereof, a receiving chamber extended through the front end and rear end thereof, a hollow screw cap threaded onto the outer thread to hold down the lamp assembly, and a rubber covering covered on one end of the lamp assembly and held in place by the hollow screw cap to seal the rear end of the hand tool; the lamp assembly is a hand torch light having an on/off button covered by the rubber covering and extended out of the hollow screw cap for operation by hand. According to another aspect of the present invention, the lamp assembly comprises two positioning rods backwardly extended from the rear end thereof at two opposite sides and respectively stopped at the inside of the hollow screw cap. According to still another aspect of the present invention, the rubber covering has a membrane top covered over the on/off switch of the lamp assembly. According to still another aspect of the present invention, the hand tool comprises a polygonal coupling hole axially provided at the front end thereof, and two positioning grooves axially provided within the polygonal coupling hole at two opposite sides; the tool elements each comprise a polygonal shank for insertion into the polygonal coupling hole at the front end of the hand tool, and two positioning flanges raised from the polygonal shank for engaging into the positioning grooves at the front end of the hand tool. As indicated above, the present invention achieves the following advantages:

1. With respect to "use":

The lamp assembly is installed in the tool handle and secured in place by the screw cap. The user can directly operate the on/off button to turn on/of the lamp assembly, or taken the lamp assembly out of the tool handle for use independently.

2. With respect to "structure and fabrication":

The tool handle is a solid member that can directly be molded from plastics. Because the tool handle is made in integrity, it has high structural strength. Because the lamp assembly is an independent implement, it can easily be installed in the tool handle. When the tool handle or the lamp assembly is damaged, the repair work can easily be performed.

3. With respect to "appearance":

Because the tool handle is made of transparent material, it admits light. When the lamp assembly is turned on, light penetrates through the peripheral wall of the tool handle, causing a sense of beauty.

4. With respect to "added function":

(a) Water proof: The rubber covering seals the rear end of the tool handle, and well protects the on/off button of the lamp assembly against moisture.

(b) Ease of use: The rubber covering has a membrane top covered over the on/off button of the lamp assembly for the pressing of the thumb to operate the on/off button of the lamp assembly comfortably.

DETAILED DESCRIPTION OF THE PREFERRED EMBODIMENT

Figure 1:
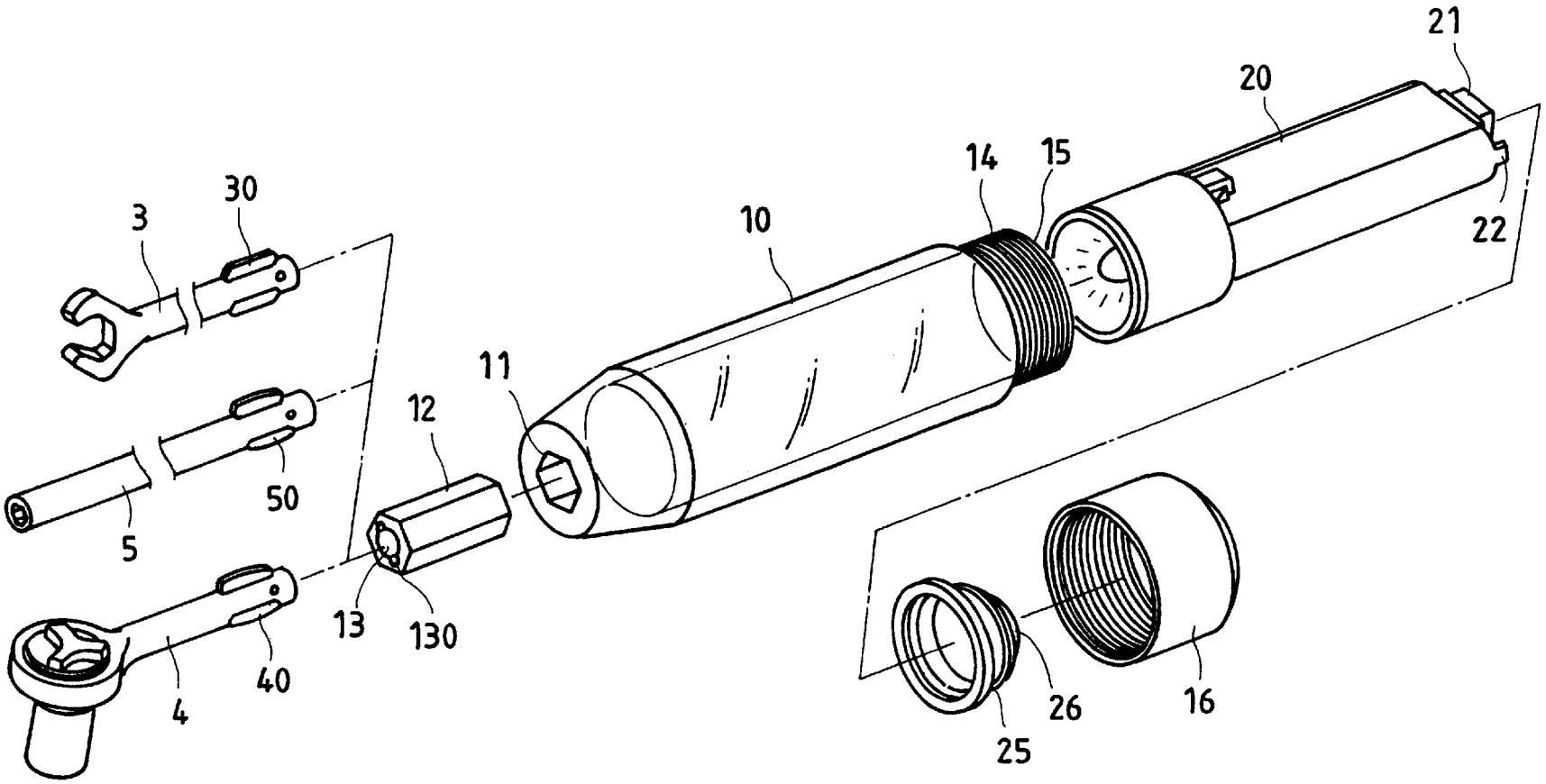
FIG. 1 is an exploded view of the present invention.
Figure 2:
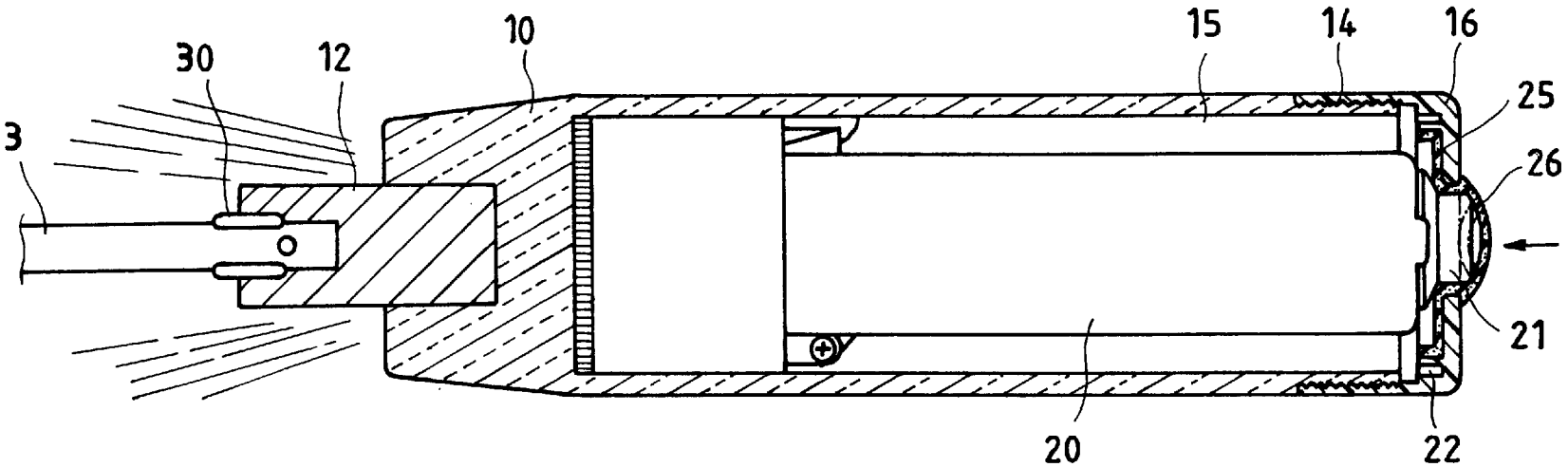
FIG. 2 is a sectional assembly view of the present invention.

Referring to FIGS. 1 and 2, the present invention comprises a hollow cylindrical tool handle 10, and a lamp assembly 20 mounted in the tool handle 10. The front end of the tool handle 10 is adapted to hold any of a variety of tool elements (screwdriver bits, ratchet socket, spanner tip, etc.). The lamp assembly 20 is controlled to emit light out of one end of the tool handle 10 for illumination.

Referring to FIGS. 1 and 2 again, the tool handle 10 is made of transparent material, so that the periphery of the tool handle 10 admits light. A polygonal coupling hole 11 is axially provided at one end, namely, the front end of the tool handle 10. A polygonal coupling tube 12 is mounted in the polygonal coupling hole 11 to hold any of a variety of tool elements, for example, a spanner tip, a ratchet socket, or a tubular socket. The polygonal coupling tube 12 comprises an axially extended coupling hole 13, and two positioning grooves 130 axially provided within the coupling hole 13 at two opposite sides. A tool element in accordance with the present invention comprises a shank 3, 4 or 5 for insertion into the coupling hole 13, and two positioning flanges 30, 40 or 50 longitudinally raised from the periphery of the shank 3, 4 or 5 for positioning in the positioning grooves 130 within the coupling hole 13 at the coupling tube 12.

The tool handle 10 further comprises an outer thread 14 at one end, namely, the rear end thereof, and a receiving chamber 15 axially extended through the front and rear ends thereof. The lamp assembly 20 is hand torch light having self-provided battery power supply means (not shown), an on/off button 21 at a rear end thereof, and two locating rods 22 backwardly raised from the rear end at two opposite sides. A hollow screw cap 16 is threaded onto the outer thread 14 at the tool handle 10 and stopped against the locating rods 22 to hold the lamp assembly 20 firmly inside tool handle 10. After installation, the on/off button 21 extends out of the center through hole (not shown) at the hollow screw cap 16 for operation by hand. Further, a rubber covering 25 is covered on the rear end of the lamp assembly 20, and held down by the hollow screw cap 16 to seal the rear end of the tool handle 10. The rubber covering 25 has a membrane top 26 covered over the on/off button 21.

Referring to FIGS. 1 and 2 again, when in use, the polygonal coupling tube 12 is mounted in the polygonal coupling hole 11 at the tool handle 10, then the shank 3, 4 or 5 of the selected tool element is inserted into the coupling hole 13 at the coupling tube 12, enabling the positioning flanges 30, 40 or 50 of the selected tool element to be engaged into the positioning grooves 130 inside the coupling tube 12, and then the lamp assembly 20 is inserted into the receiving chamber 15, and then the rubber covering 25 is covered on the rear end of the lamp assembly 20, and at final, the screw cap 16 is threaded onto the outer thread 14 at the tool handle 10 to hold the rubber covering 25 and the lamp assembly 20 in place. By means of operating the on/off button 21, the lamp assembly 20 is turned on to emit light through the front end of the tool handle 10. Further, after disconnection of the screw cap 16 from the outer thread 14 at the tool handle 10, the lamp assembly 20 can be taken away from the tool handle 10 for use as a hand torch light independently.

As indicated above, the present invention provides a hand tool having an independent lamp assembly installed therein. The independent lamp assembly has an independent on/off switch, so that it can be taken away from the hand tool for use as a hand torch light independently.

What the invention claimed is:

1. A hand tool and lamp assembly arrangement comprising a tool handle having a front end for holding any of a variety of tool elements, a set of tool elements for coupling to the front end of said tool handle, and a lamp assembly mounted in said tool handle to emit light through the front end of said tool handle, wherein said tool handle is made of transparent material, comprising an outer thread at a rear end thereof, a receiving chamber extended through the front end and rear end thereof, a hollow screw cap threaded onto said outer thread to hold down said lamp assembly, and a rubber covering covered on one end of said lamp assembly and held in place by said hollow screw cap to seal the rear end of said hand tool; said lamp assembly is a hand torch light having an on/off button covered by said rubber covering and extended out of said hollow screw cap for operation by hand.

2. The hand tool and lamp assembly arrangement of claim 1 wherein said lamp assembly comprises two positioning rods backwardly extended from the rear end thereof at two opposite sides and respectively stopped at the inside of said hollow screw cap.

3. The hand tool and lamp assembly arrangement of claim 1 wherein said rubber covering has a membrane top covered over the on/off switch of said lamp assembly.

4. The hand tool and lamp assembly arrangement of claim 1 wherein said hand tool comprises a polygonal coupling hole axially provided at the front end thereof, and two positioning grooves axially provided within the polygonal coupling hole at two opposite sides; said tool elements each comprise a polygonal shank for insertion into the polygonal coupling hole at the front end of said hand tool, and two positioning flanges raised from said polygonal shank for engaging into the positioning grooves at the front end of said hand tool.

* * * * *